US007765778B2

(12) United States Patent
Schuttler et al.

(10) Patent No.: US 7,765,778 B2
(45) Date of Patent: Aug. 3, 2010

(54) MACHINE FOR THE STRAPPING OF COMPRESSIBLE PACKAGED GOODS IN PARTICULAR, SUCH AS CORRUGATED CARDBOARD LAYERS

(75) Inventors: Karl Schuttler, Nordheim v.d. Rhon (DE); Timothy B. Pearson, Antioch, IL (US)

(73) Assignee: Signode Bernpak GmbH, Dinslaken (DE)

( * ) Notice: Subject to any disclaimer, the term of this patent is extended or adjusted under 35 U.S.C. 154(b) by 1065 days.

(21) Appl. No.: 10/930,752

(22) Filed: Sep. 1, 2004

(65) Prior Publication Data

US 2005/0044821 A1 Mar. 3, 2005

(30) Foreign Application Priority Data

Sep. 2, 2003 (DE) ..... 103 40 310

(51) Int. Cl.
*B65B 13/04* (2006.01)

(52) U.S. Cl. ..... 53/528; 53/399; 53/589; 100/26

(58) Field of Classification Search ..... 53/528, 53/589, 590, 399; 100/25, 26, 29, 32
See application file for complete search history.

(56) References Cited

U.S. PATENT DOCUMENTS

| | | | | | |
|---|---|---|---|---|---|
| 3,613,557 | A | * | 10/1971 | Coleman | 100/26 |
| 3,831,512 | A | * | 8/1974 | Johnson | 100/26 |
| 4,120,239 | A | * | 10/1978 | Pasic et al. | 100/26 |
| 4,222,323 | A | | 9/1980 | Martindale | |
| 4,256,032 | A | * | 3/1981 | Davis | 100/26 |
| 4,559,767 | A | * | 12/1985 | Takami | 53/589 |
| 4,691,498 | A | * | 9/1987 | Stamm | 53/399 |
| 4,870,807 | A | * | 10/1989 | Palamides et al. | 53/528 |
| 4,938,009 | A | * | 7/1990 | Takami | 53/589 |
| 5,078,058 | A | * | 1/1992 | Schwede et al. | 100/32 |
| 5,289,668 | A | * | 3/1994 | Meyer | 53/410 |
| 5,791,238 | A | * | 8/1998 | Garbotz | 100/32 |
| 6,546,696 | B2 | * | 4/2003 | Cranston et al. | 53/399 |
| 6,622,619 | B1 | * | 9/2003 | Liu et al. | 100/4 |
| 6,786,027 | B2 | * | 9/2004 | Oda et al. | 53/589 |
| 2002/0116900 | A1 | | 8/2002 | Cranston, III et al. | |

FOREIGN PATENT DOCUMENTS

| | | |
|---|---|---|
| DE | 38 13 723 C2 | 11/1988 |
| DE | 203 13 581 | 11/2003 |
| EP | 0 681 958 | 11/1995 |
| EP | 0 681 958 B1 | 11/1995 |
| GB | 2 053 132 | 2/1981 |

* cited by examiner

*Primary Examiner*—Thanh K Truong
(74) *Attorney, Agent, or Firm*—Lowe Hauptman Ham & Berner, LLP

(57) ABSTRACT

A strapping machine includes a supply unit, a guidance frame, a pressing plate, feeder runners, a closure aggregate, a storage unit, a feeder, an insertion device and a guidance structure. The closure aggregate is vertically aligned with the pressing plate and maneuverable, whilst the supply unit is located within close proximity of the strapping area and the pressing plate. The guidance structure includes one canal-like transfer line leading at least to the closure aggregate. The insertion device is accessible from outside, is aligned with the supply unit and is attached to a lower section of an automatically opened guidance canal. The strapping material is fed synchronically to the transfer line with the pressing plate adjustable for height. The insertion mechanism incorporates feeder and runners. The storage unit adjacent to the supply unit is aligned to the exterior of the strapping area.

21 Claims, 2 Drawing Sheets

FIG.1
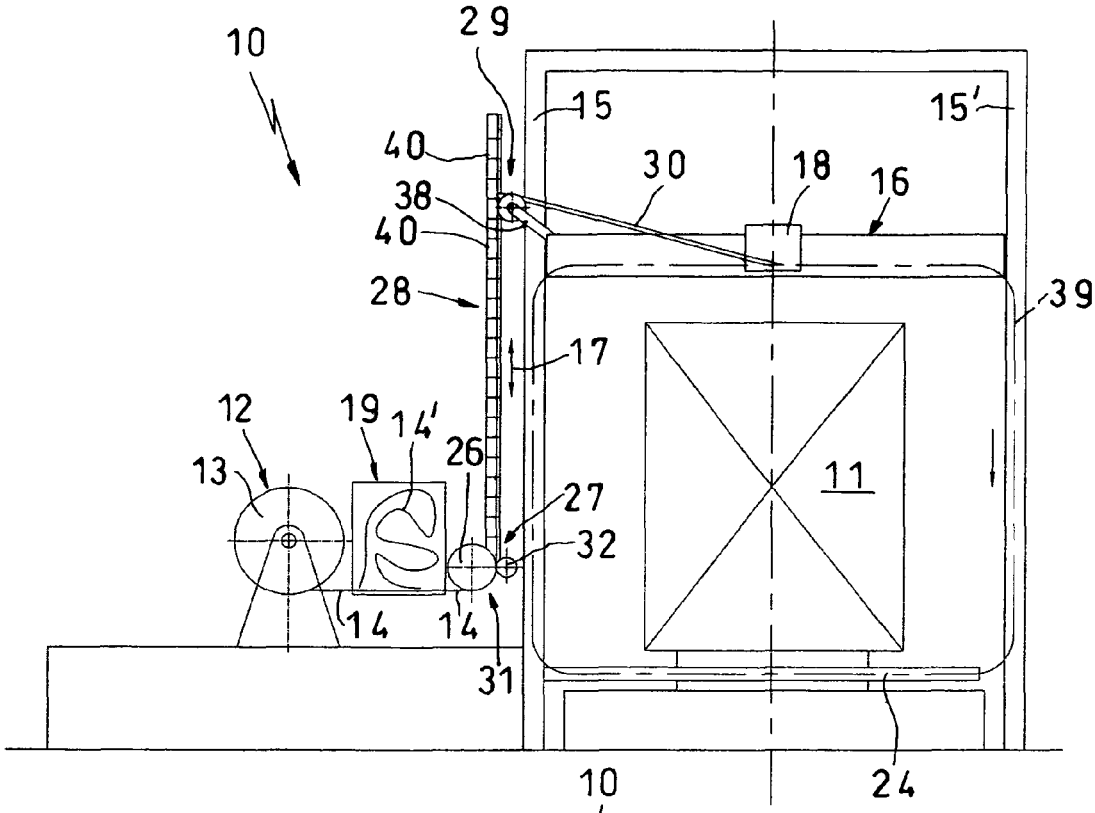
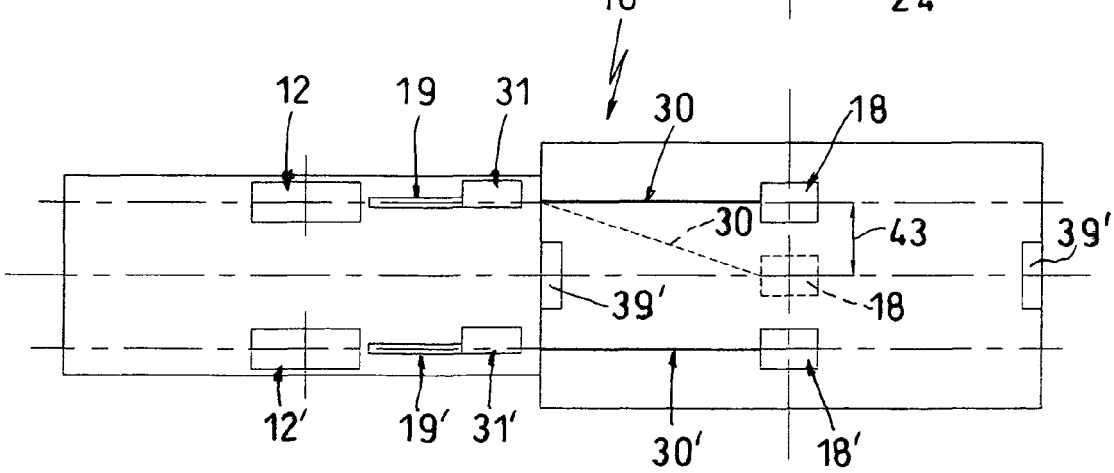
FIG.2

MACHINE FOR THE STRAPPING OF COMPRESSIBLE PACKAGED GOODS IN PARTICULAR, SUCH AS CORRUGATED CARDBOARD LAYERS

RELATED APPLICATIONS

The present application is based on, and claims priority from, German Application Number 103 40 310.8, filed Sep. 2, 2003, the disclosure of which is hereby incorporated by reference herein in its entirety.

FIELD OF THE INVENTION

The invention at hand concerns a machine for the strapping of compressible packaged goods in particular, such as corrugated cardboard layers, as has for example become well-known from EP 0 681 958 B1.

BACKGROUND OF THE INVENTION

This machine straps packaged goods by means of a strap-like material and above all by means of a thermoplastic synthetic strap. The material used for strapping is located within a supply unit for the strapping material, which is housed at the side of the machine within close proximity of the ground. The strapping material which has been pulled out of the supply unit is then fed through a conveyor belt device aligned alongside the supply unit and then in turn fed into an adjacent strapping material feeder. From here, the strapping material is led via a vertical strapping material guidance mechanism and a deflecting device, as well as a transfer line, until the strapping material reaches the closure aggregate.

The closure aggregate, which is maneuverable synchronically with the pressing plate in the vertical direction of the machine like the deflecting device and transfer line, are aligned with the strapping material conveying runners in the case of the well-known machine. These are first and foremost responsible for leading the strapping material into and through a strapping canal which surrounds and is wound around the packaged goods, until the leading end of the strapping material has reached the closure aggregate once again. The conveying runners then have the task of tightening the strapping material, whose leading end is from now on held tight in the closure aggregate, around the packaged goods. For this purpose the drive of the strapping material conveying runners are reversible so that the strapping material can be pulled out of the strapping canal and tightened around these packaged goods once the direction of the drive has been reversed, whereupon the closure aggregate then creates the strap closure in the well-known way by means of thermal fusing of the strap ends overlapping in the closure aggregate.

SUMMARY OF THE INVENTION

It is generally customary—with the machine according to EP 0 681 958 B1 as well—at least not to pull out the strapping material to be fed into the strapping canal in the fully required length, but rather to gather it with as little tensile strength as possible from a storage of strapping material, which contains a certain amount of strapping material. With the machine according to EP 0 681 958 B1, such a storage unit for strapping material is located immediately in front of the conveying runners which are aligned with the closure aggregate in a configuration attached to the pressing plate. The conveying runners can therefore gather the necessary strapping material length in the shortest way from the storage for strapping material.

For a better understanding of the invention explained in the following document it should be pointed out that the invention 25 described in EP 0 681 958 B1 as a "Strapping Material Injection Machine" essentially serves to feed strapping material to the closure aggregate with the initial start-up of the machine or after a change of the supply of the strapping material, and can therefore be described more accurately as a "Strapping Material Feeding Machine". The conveying runners 23 represent on the other hand the actual strapping material feeding machine, whose job it is to create material straps in the strapping cycle of the machine. As the strapping material conveying runners also tighten the strapping material around the packaged goods by retracting surplus strapping material, the conveying runners 23 of EP 0 681 958 B1 are de facto essential components of a "Strapping Material Insertion and Retraction Appliance".

The well-known machine according to EP 0 681 958 B1 has proved itself outstandingly over its years of operation in terms of its reliability and speed. As opposed to previous machines of its kind, so-called "Packaging Presses", clear service advantages have been achieved because it has become possible to feed a new strapping material beginning in the closure aggregate from the ground upwards in every user-defined operating position of the machine.

The invention at hand had therefore recognized a need for improvement, as is desirable in the case of an operating fault, and necessary with access in particular to the conveying runners adjacent to the closure aggregate as well as the storage of strapping material to be improved to the extent that it is no longer necessary to mount the pressing plate or to lower it to ground level.

It is therefore an essential task of the invention to be designed around a machine established in a pre-conditional manner, so that maintenance work in the case of operation faults concerning the strapping material are greatly reduced.

The invention solves this problem and is therefore distinguished by the fact that the feeding appliance incorporates the conveying runners and that the storage of the strapping material, which is adjacent to the supply unit, is aligned within close proximity of the ground to the side on the exterior of the strapping area.

The essential core of the invention thus consists of a modular assembly, meaning that no more strap driving mechanisms—neither the conveying runners nor the detracting runners—are immediately aligned to the closure aggregate itself, and incidentally that it is not the storage of strapping material, but rather that these machine aggregates are aligned together with the supply unit and feeder in close proximity to the floor and to the side on the exterior of the strapping area and are therefore able to be reached from the ground without any problems by service and maintenance personnel.

In accordance with the design it is planned that the feeder appliance leads the strapping material both to the closure aggregate as well as through this and along the strapping material guidance frame and tightening it around the packaged goods.

The strapping material guidance frame consists preferably of a reversible pair of runners, which can be driven alternately either as a detraction runner pair or as a feeding runner pair.

In accordance with another criterion of a machine under the terms of the invention, the transfer line feeds the strapping material along the shortest route and immediately from the deflection mechanism to the closure aggregate.

A design of the invention therefore incorporates the fact that the storage for the strapping material—viewed in terms of the direction of the strapping material—is aligned between the supply unit and the feeder and that the filling of the storage takes place by detraction of the strapping material by means of the feeder mechanism.

With the exception of rare faults, with which immediate access to the closure aggregate itself is required, all faults caused by strapping material can be corrected from now on from the ground, without the pressing plate firstly having to be mounted by a technician or the pressing plate having to be lowered towards the ground, whereby the latter would in most cases make it necessary for the packaged goods in the strapping area to be removed beforehand.

The invention at hand does not exhaust the possibility of storing the strapping material storage away from the pressing bars and the conveying runners away from the closure aggregates next to the machine leading to a new way of operating and to the saving of aggregate parts. It unites the former feeder machine with the strapping material insertion and detraction mechanisms in one aggregate, which takes on the tasks of the two aforementioned mechanisms, whereby two reversible roll pairs suffice.

The machine also differentiates itself according to the invention in line with EP 0 681 958 B1 in that all influences on the strapping material—both its feeding and insertion as well as detraction—are controlled or completed by the aggregate aligned in close proximity to the ground. The aggregate which combines the feeder mechanism with the insertion and detraction mechanism is from now on responsible for the filling of strapping material storage and for the withdrawal of strapping material. This all leads ultimately to the simplification of the controls as two separate aggregates do not have to be operated any longer, nor do they have to be operated in an exact order.

As with the strapping material detraction during the phase within which the strapping material is drawn from the canal and tightened around the packaged goods, and with the machine according to the invention a relatively long strapping material segment has to be operated, whereby large detraction powers are necessary, the invention for the protection of strapping material and of the guidance allows for the fact that the deflection mechanism incorporates a deflection mechanism and runners, which are pivotal and stored on the pressing plate and by means of a carriage which is manoeuvrable along the intermediate guidance, which serially opens canal closure formed by the closed spring-loaded flaps. Due to the deflection runners which are driven by the strapping material and to the controlled flaps, the sliding friction afflicted by abrasion is largely avoided. This in turn leads to a decrease in the forces which the strapping material is exposed to during insertion and detraction, so that movement is made easier.

Another criterion ensures an increase in machine performance with at least two guidance frames on parallel, vertical levels, between which the closure aggregate is displaceable, so that the strapping material transfer line between the deflection mechanism and the closure aggregate is preferably coercively coupled and swivel-mounted with the closure aggregate.

BRIEF DESCRIPTION OF THE DRAWING

The invention can be understood with the use of the following description of an operating example. The figures show the following:

FIG. 1 A schematic side aspect of the machine for strapping compressible packaged goods in particular, such as corrugated cardboard.

FIG. 2 A schematic aerial aspect of the machine shown in FIG. 1

DETAILED DESCRIPTION OF THE INVENTION

Figures 3, 4:
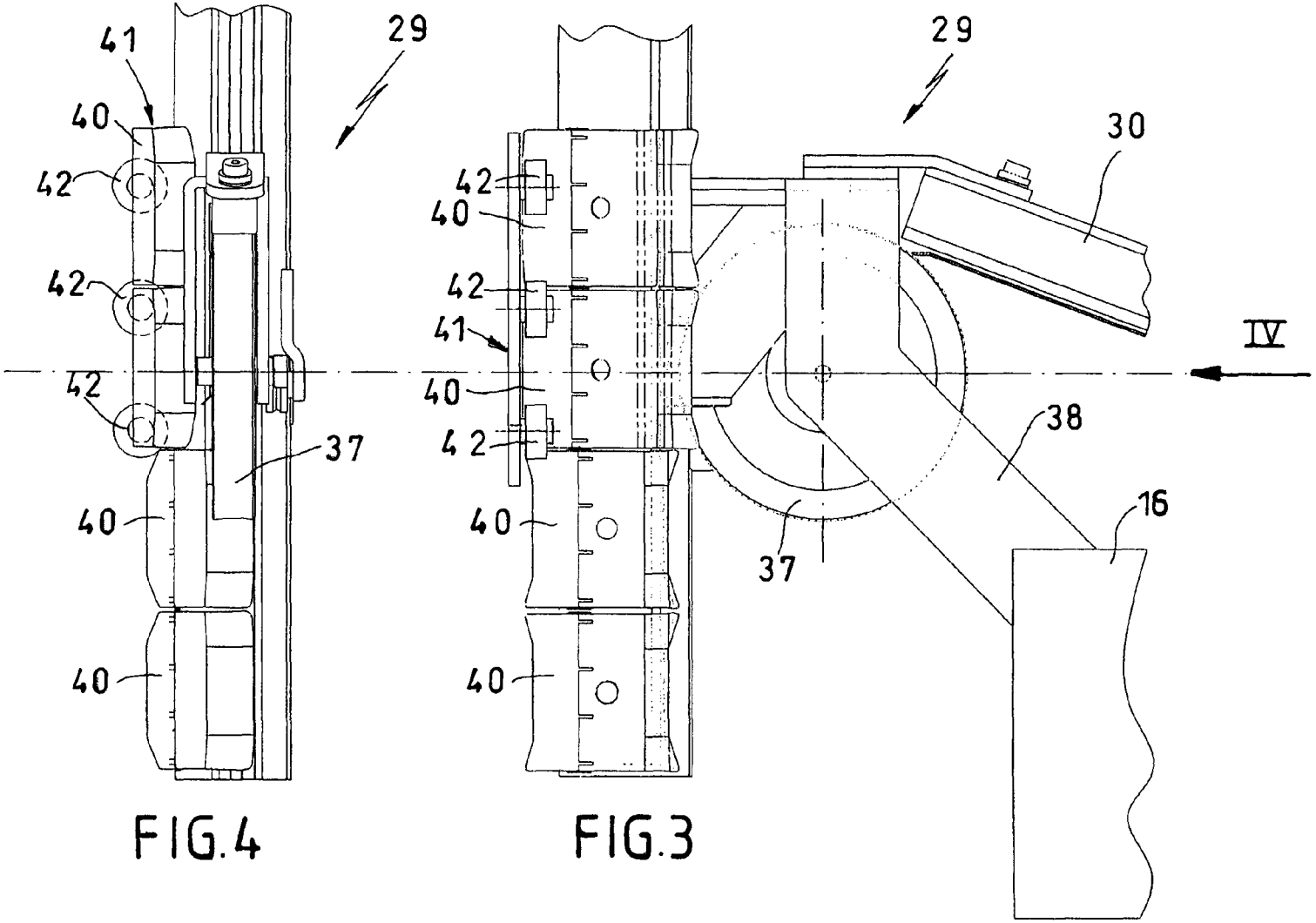
FIG. 3 A detailed depiction of the strapping material deflection and transfer line mechanisms with the machine in side aspect and FIG. 4 A viewpoint from the direction of arrow IV as shown in FIG. 3

A machine for the strapping of compressible packed goods 11 such as corrugated cardboard is denoted by 10 and incorporates the strapping material supply unit housed within close proximity of the ground (12), with strapping material 14 on a drum 13, above all thermally fused synthetic straps.

At post 15, 15' is a cross bar 16 aligned and vertically manoeuvrable in the direction of the double-arrow 17. The cross bar 16 forms a pressing plate to compress the packaged goods 11 from or is alternatively its component and stores an aggregate 18 for the formation of a strapping closure on its upper side, which is why aggregate 18 will from now on be described as a closure aggregate.

On the side next to post 15 a vertical strapping guidance 28 is to be designed, through which the strapping material supply unit 12 feeds the strapping material 14 to the closure aggregate 18.

Intermediate strapping material storage 19 is planned alongside the strapping material supply unit 12. It serves to provide a certain amount of strapping material 14' to the strapping material 14. This strapping material amount 14' suffices either for at least the strapping of the packaged goods 11 or for the beginning of a strapping, whereby the amount of additional strapping required is taken directly from the supply unit 12. In the last-mentioned case the drum 13 is pre-accelerated by a traction system not depicted here to eliminate its persistence momentum.

The strapping material 14 escaping or pulled from the strapping material storage 19 then moves into a machine denoted overall by 31, which amongst other things feeds the strapping material 14 into the strapping material guidance mechanism 28.

Further up a strapping material deflection mechanism 29 and a strapping material guidance line mechanism or transfer line 30 are depicted. The strapping material deflection mechanism 29 which takes on the strapping material 14 from the guidance mechanism 28 and leads it into the transfer line 30, are implemented as the freely rotating runners 37 from the strapping material 14.

Whilst the strapping material guidance mechanism 28 is fixed, the deflection mechanism 29, the transfer line mechanism 30 and the closure aggregate 18 are uniformly mobile and fixed to the pressing plate 16, in so far as they are constantly manoeuvrable together with this pressing plate 16 in a vertical direction (double arrow 17). The strapping material deflection mechanism 29 is implemented here as the runner 37 and stored on a fixed extension 38.

The mechanism 31 which is between the strapping material storage 19 and the insertion mechanism (next to 27) and the guidance mechanism 28 consists of two runners 26 and 32, which can move in both directions horizontally by means of the friction of the strapping material 14. Both of these runners 26, 32, which are at least motor-powered and reversible, have—as is explained in the following—several functions:

A. For the initial and new filling of the machine 10 with the strapping material 14 or after a change of the strapping material supply unit 12 the runners 26, 32 are driven in such a way that the strapping material 14, which has been fed into storage 19 by hand, is fed through the strapping material feeder 27 into the guidance mechanism 28, and from there via the deflection mechanism 29 through the transfer line 30 and the closure aggregate 18, into and through the strapping material canal 39, until the leading end of the strapping material 14 has reached the closure aggregate 18 again. The runners 26, 32 therefore have a function of their own as strapping material feeder runners.

B. With the implementation of an initial strapping of packaged goods 11 in connection with one of the operations described above—with the end of the strapping material held tight in the closure aggregate—the drive of the runners is then reversed, i.e. the runners 26, 32 are driven in the opposite direction. Now the runners 26, 32 draw the strapping material 14 back with the effect that on the one hand the strapping material storage 19 is filled with an amount of strapping material 14', and on the other hand that the strapping material 14 located in the frame is pulled from this in towards the packaged goods 11 and tightened around the packaged goods 11. The function of the runner 26, 32 is therefore one of a strapping material detracting and tightening mechanism. The closure aggregate 18 now produces the strapping material closure, as is essentially known and customary. (In order to avoid any misunderstandings it should be noted that, unlike in the schematic representation of FIG. 1, the press bar 16 lies on top of the packaged goods under compression pressure).

C. Consumption of the strapping material 14 up to the storage 12 and the closure aggregate 18 suffices for the consequent and every future strapping cycle of the machine 10. For another strapping the runners 26, 32 are reversed once again, so that they are able to feed the strapping material 14 out of the closure aggregate 18 and around the canal 39. As this procedure is generally described as "strap insertion", the runners 26, 32 now have the function of strapping material; insertion runners. From now on all other strapping procedures follow the steps outlined in b. and c.

Prior to each strapping procedure the pressing plate 16 is lowered under pressure from above onto the packaged goods 11. Here the closure aggregate 18, the transfer line mechanism 30 and the deflection mechanism 29, which are all attached to the pressing plate 16 and are uniformly manoeuvrable, also move vertically. The distance of the deflection mechanism 29 e.g. from the ground, is altered according to the respective height of the packaged goods 11. It is therefore necessary for the deflection mechanism 29 to be able to extract the strapping material 14 in every possible height position of the guidance mechanism 28. For this the canal-like guidance mechanism 28 shows an alignment of flaps 40 surrounding the canal, which are normally spring-loaded (not shown in fig.), which are aligned in pairs on both sides of the strapping material guidance mechanism 28.

The flap system and its controls are shown more clearly in FIGS. 3 and 4. The alignment is formed in such a way that a slide 41 is connected to the deflection mechanism 29 and move uniformly in a vertical direction. The slide 41 carries the runners 42, which all lie along the edges of the flaps 40 on one side (see left side of FIG. 3), and open the flaps 40 to the side pointing towards the runner 37, so that the strapping material 14 (not shown in FIGS. 4 and 3) can be fed out of the canal of the strapping material guider 28 and via the runner 37 and the deflection mechanism 29, and then in turn into the strapping material transfer line. In FIGS. 3 and 4 the two highest flaps pairs of the four shown, adjacent to the runner 37, are open, when the two lower flaps are closed forming the canal.

With reference to FIG. 2 it should be mentioned that the machine depicted is operated as a "Tandem Machine", which consists of two supply units 12, 12', two storage mechanisms 19, 19' and two drive aggregates 31, 31' in adjacent alignment, as well as two closure aggregates 18 and 18', all of the other machine components described such as the transfer lines 30, 30', the strapping material guidance and canals. Two strapping cycles parallel to one another can be carried out around packaged goods with this tandem machine. A threefold alignment is also possible and has already been tested.

FIG. 2 also shows a tandem machine with which packaged goods 11 can be strapped at differing parallel distances from one another. The closure aggregate 18 is therefore manoeuvrable in a cross direction (double arrow 43). The strapping material transfer line 30 is therefore flexibly attached on the one side to the closure aggregate 18 and on the other side to the deflection mechanism 29 (FIG. 1), so that the strapping material path can automatically follow the slanting shift of the closure aggregate 18. In the secondary position of the closure aggregate (see the dashed lines in FIG. 2) another strapping material frame 39' is required as a result.

It only remains to explain a number of details for a complete understanding of the machine 10, even if these details are not necessary directly concerned with the invention itself.

Both the posts 15, 15' and the cross bar 16 are aligned to strapping material guidance in the form of straight canals or sections of canal and corner deflections in the familiar manner. It is likewise well-known to therefore form the portal-like guidance structure to one enclosed within the strapping material frame, which is for the packaged goods 11 or palette upon it is stored on the ground side and an underlying lance or bayonet 24 which contains a straight guidance canal. In terms of such an alignment and design EP 0 681 958 B1, named at the beginning, should be referred to.

The invention claimed is:

1. A strapping apparatus, comprising:

a plurality of upright elements;

a transverse element moveable up and down along said upright elements;

a strapping zone which is defined by said upright elements and said transverse element and in which an object to be strapped is positioned for strapping;

a strapping material supplying unit for supplying a strapping material for strapping the object;

a closing unit for closing a loop of the strapping material guided around the object by said upright and transverse elements, said closing unit being moveable together with said transverse element;

a pair of reversibly driven rollers for feeding the strapping material from said supplying unit to said closing unit when said rollers are driven in a first rotational direction, and for tightening the strapping material in the loop around the object when said rollers are driven in a second rotational direction opposite to the first direction;

an upright channel positioned downstream of said rollers and configured to extend along beside and outboard of one of the upright elements for guiding the strapping material upwardly from said rollers; and a strapping material storage for storing a length of the strapping material moved back from the tightened loop by said rollers being driven in the second direction, said strapping material storage being positioned proximate a base of said upright channel so as to be downstream of said supplying unit and upstream of said rollers;

wherein said strapping material storage and said rollers are positioned outside said strapping zone at all times.

2. The apparatus of claim 1, wherein said transverse element is moveable relative to said strapping material storage.

3. The apparatus of claim 2, wherein said strapping material storage and said rollers are positioned at a level of a lower portion of said strapping zone and are always accessible at said level regardless of a position of said transverse element relative to said upright elements and regardless of a presence or absence of the object in said strapping zone.

4. The apparatus of claim 3, wherein said supplying unit, said strapping material storage and said rollers are substantially co-elevational at all times.

5. The apparatus of claim 3, further comprising:

a transferring element positioned downstream of said upright channel for guiding the strapping material from said upright channel to said closing unit; and a deflector positioned between said upright channel and said transferring element for deflecting the strapping material from said upright channel to said transferring element, said deflector being fixed to and moveable together with said transverse element.

6. The apparatus of claim 5, wherein said upright channel is configured to receive the strapping material from said rollers, and is configured to have flaps which are located at least at the upper end of said upright channel and which are openable by said deflector during up and down movements of said deflector together with said transverse element.

7. The apparatus of claim 6, comprising multiple said supplying units, strapping material storages, pairs of reversibly driven rollers, transverse elements, and closing units which are disposed side by side for strapping the object by multiple loops of the strapping material disposed in multiple parallel vertical planes.

8. The apparatus of claim 6, wherein said closing unit is further moveable in planes transverse to said upright elements for strapping the object by multiple loops of the strapping material disposed in multiple parallel vertical planes; and said transferring element is flexibly attached between said closing unit and said deflector for following movements of said closing unit in the transverse planes.

9. The apparatus of claim 1, wherein said strapping material storage and said rollers are positioned at a level of a lower portion of said strapping zone and are always accessible at said level regardless of a position of said transverse element relative to said upright elements and regardless of a presence or absence of the object in said strapping zone.

10. The apparatus of claim 9, wherein said supplying unit, said strapping material storage and said rollers are substantially co-elevational at all times.

11. A strapping apparatus, comprising:

a strapping material supplying unit for supplying a strapping material for strapping an object to be strapped;

a frame for guiding the strapping material around the object, said frame comprising a plurality of upright elements and a transverse element moveable up and down along said upright elements, said frame defining a strapping zone in which the object is positioned for strapping;

a closing unit for closing a loop of the strapping material guided around the object by said frame, said closing unit being moveable together with said transverse element;

a pair of reversibly driven rollers for feeding the strapping material from said supplying unit to said closing unit when said rollers are driven in a first rotational direction, and for tightening the strapping material in the loop around the object when said rollers are driven in a second rotational direction opposite to the first direction;

a strapping material storage for storing a length of the strapping material moved back from the tightened loop by said rollers being driven in the second direction, said strapping material storage being positioned downstream of said supplying unit and upstream of said rollers and being stationary relative to said upright elements; and an upright channel extending along side one of said upright elements for guiding the strapping material upwardly from said rollers, said upright channel having a lower end portion positioned downstream of said rollers for receiving the strapping material from the strapping material storage via said rollers, and an upper end portion from which the strapping material is to be fed to said closing unit.

12. The apparatus of claim 11, wherein said strapping material storage and said rollers are both positioned at a level of the lower end portion of said upright channel and are always accessible at said level regardless of a position of said transverse element relative to said upright elements and regardless of a presence or absence of the object in said strapping zone.

13. The apparatus of claim 12, wherein said supplying unit, said strapping material storage and said rollers are substantially co-elevational at all times.

14. The apparatus of claim 12, further comprising:

a transferring element positioned downstream of said upright channel for guiding the strapping material from the upper portion of said upright channel to said closing unit; and a deflector positioned between said upright channel and said transferring element for deflecting the strapping material from said upright channel to said transferring element, said deflector being fixed to and moveable together with said transverse element, the upper end portion of said upright channel having flaps which are openable by said deflector during up and down movements of said deflector.

15. The apparatus according to claim 14, wherein said strapping material is fed along a straight line immediately to said closing unit from said deflector thereby providing said strapping element a shortest route to travel from said deflector, positioned between said upright channel and said transferring element, to said closing unit.

16. The apparatus of claim 14, comprising multiple said supplying units, strapping material storages, pairs of reversibly driven rollers, transverse elements, and closing units which are disposed side by side for strapping the object by multiple loops of the strapping material disposed in multiple parallel vertical planes.

17. The apparatus of claim 14, wherein said closing unit is further moveable in planes transverse to said upright elements for strapping the object by multiple loops of the strapping material disposed in multiple parallel vertical planes; and said transferring element is flexibly attached between said closing unit and said deflector for following movements of said closing unit in the transverse planes.

18. The apparatus of claim 11, wherein said transverse element is moveable relative to said strapping material storage, and said strapping material storage and said rollers are positioned outside said strapping zone at all times.

19. The apparatus of claim 11, wherein said strapping material storage and said rollers are positioned at a level of the lower end portion of said upright channel and are always accessible at said level regardless of a position of said transverse element relative to said upright elements and regardless of a presence or absence of the object in said strapping zone.

20. The apparatus of claim 19, wherein said supplying unit, said strapping material storage and said rollers are substantially co-elevational at all times.

21. The apparatus of claim 11, wherein said frame for guiding the strapping material around the object further includes an underlying lance having a substantially straight uninterrupted guidance channel which extends below the object.

* * * * *